US011485525B2

(12) United States Patent
Sala

(10) Patent No.: US 11,485,525 B2
(45) Date of Patent: Nov. 1, 2022

(54) ENHANCED APPARATUS FOR FILLING BAGS

(71) Applicant: SACLARK S.R.L., Bolzano (IT)

(72) Inventor: Gianmario Sala, Bolzano (IT)

(73) Assignee: SACLARK S.R.L., Bolzano (IT)

( * ) Notice: Subject to any disclaimer, the term of this patent is extended or adjusted under 35 U.S.C. 154(b) by 592 days.

(21) Appl. No.: 16/321,945

(22) PCT Filed: Aug. 2, 2017

(86) PCT No.: PCT/IB2017/054716
§ 371 (c)(1),
(2) Date: Jan. 30, 2019

(87) PCT Pub. No.: WO2018/025193
PCT Pub. Date: Feb. 8, 2018

(65) Prior Publication Data

US 2021/0292018 A1 Sep. 23, 2021

(30) Foreign Application Priority Data

Aug. 3, 2016 (IT) ..... UA2016A005796

(51) Int. Cl.
*B65B 9/093* (2012.01)
*B65B 25/04* (2006.01)
(Continued)

(52) U.S. Cl.
CPC ..... *B65B 9/093* (2013.01); *B65B 25/048* (2013.01); *B65B 35/54* (2013.01); *B65B 39/02* (2013.01); *B65B 39/12* (2013.01); *B65B 2220/16* (2013.01)

(58) Field of Classification Search
CPC ..... B65B 9/093; B65B 25/048; B65B 35/54; B65B 39/02; B65B 39/12; B65B 2220/16; B65B 2220/20
See application file for complete search history.

(56) References Cited

U.S. PATENT DOCUMENTS 4,564,975 A * 1/1986 Kuffner ..... E05D 3/16 16/366
5,813,196 A * 9/1998 Page ..... B65B 5/067 53/171
(Continued)

FOREIGN PATENT DOCUMENTS

DE 3210721 A1 10/1983
EP 0076093 A1 4/1983
(Continued)

*Primary Examiner* — Thomas M Wittenschlaeger
(74) *Attorney, Agent, or Firm* — Dickinson Wright PLLC; Andrew D. Dorisio

(57) ABSTRACT

An enhanced apparatus (10) for filling bags containing products, in particular fruit and vegetable products, arranged in first bags (16) having dimensions smaller than second bags filled with said first bags and comprising a feeding station (12) which feeds first bags (16) to a second bag filling station (18) which fills second bags with the first bags (16), a meshed material feeding station (20) to form bands of second bags, a closing and cutting station (22) which closes and cuts second bags filled with the first bags, said filling station (18) being an intermediate station between said meshed material feeding station (20) and said closing and cutting station (22), the apparatus comprising automatic sorting and selection means, integrated in the filling station (18), which automatically sort and select the first bags (16) fed by the feeding station (12) to transportation means suitable for moving said first bags (16), after being sorted, towards collection/accumulation means comprising unloading means providing for a centered downloading of said first bags into second bags.

12 Claims, 4 Drawing Sheets

Figure 1:
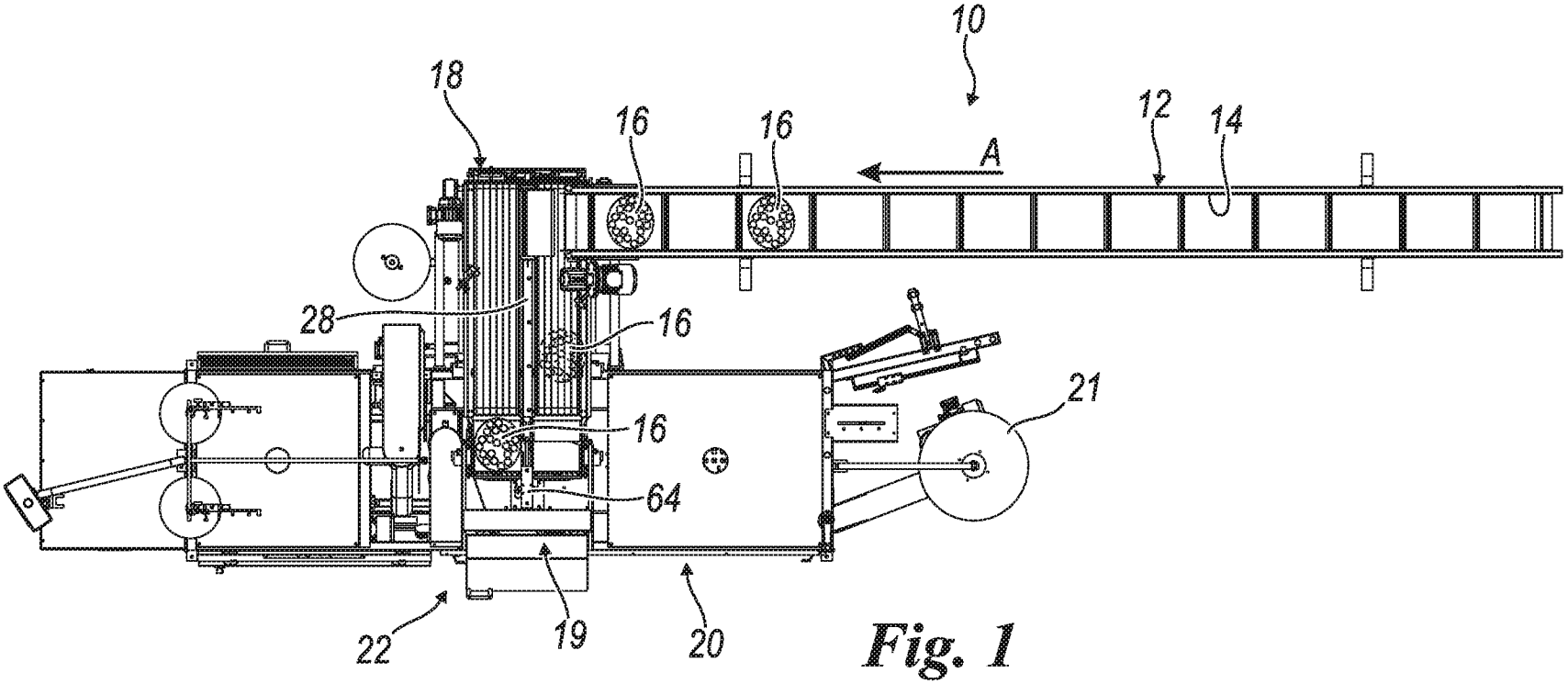

(51) Int. Cl.

| | |
|---|---|
| ***B65B 35/54*** | (2006.01) |
| ***B65B 39/02*** | (2006.01) |
| ***B65B 39/12*** | (2006.01) |

(56) References Cited

U.S. PATENT DOCUMENTS

| | | | | |
|---|---|---|---|---|
| 6,564,927 | B2 * | 5/2003 | Meyer | B65B 5/08 193/46 |
| 6,779,321 | B1 * | 8/2004 | Kelemen | B65B 9/13 53/168 |
| 7,861,498 | B2 * | 1/2011 | Sugioka | B65G 69/16 53/502 |
| 2003/0101686 | A1 * | 6/2003 | Savigny | B65B 39/08 53/253 |
| 2009/0199512 | A1 * | 8/2009 | Sala | B65B 5/108 53/448 |
| 2020/0317382 | A1 * | 10/2020 | Savoie-Lavigueur | B65B 57/145 |

FOREIGN PATENT DOCUMENTS

| | | | |
|---|---|---|---|
| WO | WO0194201 | A2 | 12/2001 |
| WO | WO2007125411 | A2 | 11/2007 |

* cited by examiner

ENHANCED APPARATUS FOR FILLING BAGS

TECHNICAL FIELD

The present invention refers to an enhanced apparatus for filling bags.

BACKGROUND

More specifically, the present invention refers to an apparatus for filling bags, in particular with fruit and vegetable products (oranges, lemons, vegetables such as potatoes, onions or the like) and, more specifically, said fruit and vegetable products being pre-packaged loose and freely movable internally to further bags.

It is known that the products intended for large scale distribution and, in particular, the fruit and vegetable products are packaged in big-size bags, which operate as a packing for transportation and internally thereto contain a plurality of small-size bags containing fruit and vegetable products.

For explanatory purposes only, one big-size bag having a capacity of 25 kg can accommodate at least ten smaller bags (filled with fruit and vegetable products), complete with a label and having a weight ranging from 0.5 to 5 kg; this allows an easier transportation of the products.

This operation whereby smaller bags are accommodated in bigger bags can be performed manually, which entails a number of drawbacks bound to longer packaging times, counting errors made by operators and, consequently, longer production times which in turn result in high production costs.

Alternatively, packaging can take place automatically, which advantageously reduces the production times and consequently their respective costs.

However, the traditional automatic apparatuses suitable for this purpose also feature a number of major drawbacks, bound to the fact that the smaller bags containing the fruit and vegetable products, owing to the high speed of the packaging apparatuses, are fed to the bigger bags randomly, which results in frequent problems bound to the difficulty of filling such bigger bags more uniformly and to the need for accommodating a constant number of smaller bags in said bigger bags.

For instance, document WO2007/125411 describes an apparatus for filling bags with smaller-size bags, said smaller bags being moved on conveyor means the function of which is to convey said bags to a ramp-openable dispensing zone to make the small bags fall into the bigger ones; however, such solution features a number of drawbacks bound to the ramp in the dispensing zone, which entails a slowing down of the smaller bags during their fall and, also, it does not allow an optimal and centered fall of the bags and, consequently, it entails problems bound to the extended production times and associated costs.

SUMMARY

An object of the present invention is to obviate the above-mentioned drawbacks.

More specifically, an object of the present invention is to provide an enhanced apparatus for filling bags suitable for allowing an optimization of the packaging process in terms of an increased production yield.

A further object of the present invention is to provide an apparatus suitable for allowing for a correct filling of the bags, while substantially zeroing the number of rejected products and also such as to allow to keep the number of products filled in the bags, constant.

A further object of the present invention is put at the users' disposal an enhanced apparatus for filling bags, suitable for providing for a high strength and reliability over time and also such as to be implemented in an easy and cost-effective manner.

These objects and others are achieved by the invention that features the characteristics according to claim 1.

In accordance with the invention, an enhanced apparatus is provided for filling bags with products, in particular with fruit and vegetable products, arranged in first bags having dimensions smaller than second bags filled with such first bags and comprising a first bag feeding station which fills a second bag filling station with the first bags, a meshed material feeding station used to form bands of second bags, a second bag closing and cutting station which closes and cuts the second bags filled with the first bags, said filling station being an intermediate station between said meshed material feeding station and said closing and cutting station, the apparatus comprising automatic sorting and selection means, integrated with the filling station, which automatically sort and select the first bags fed from the feeding station to transportation means suitable for moving said sorted first bags and transferring them to collection/accumulation means comprising unloading means which provides for a centered unloading of said first bags into second bags.

Advantageous implementations of the invention are apparent from the dependent claims.

BRIEF DESCRIPTION OF THE DRAWING FIGURES

Figure 1A:
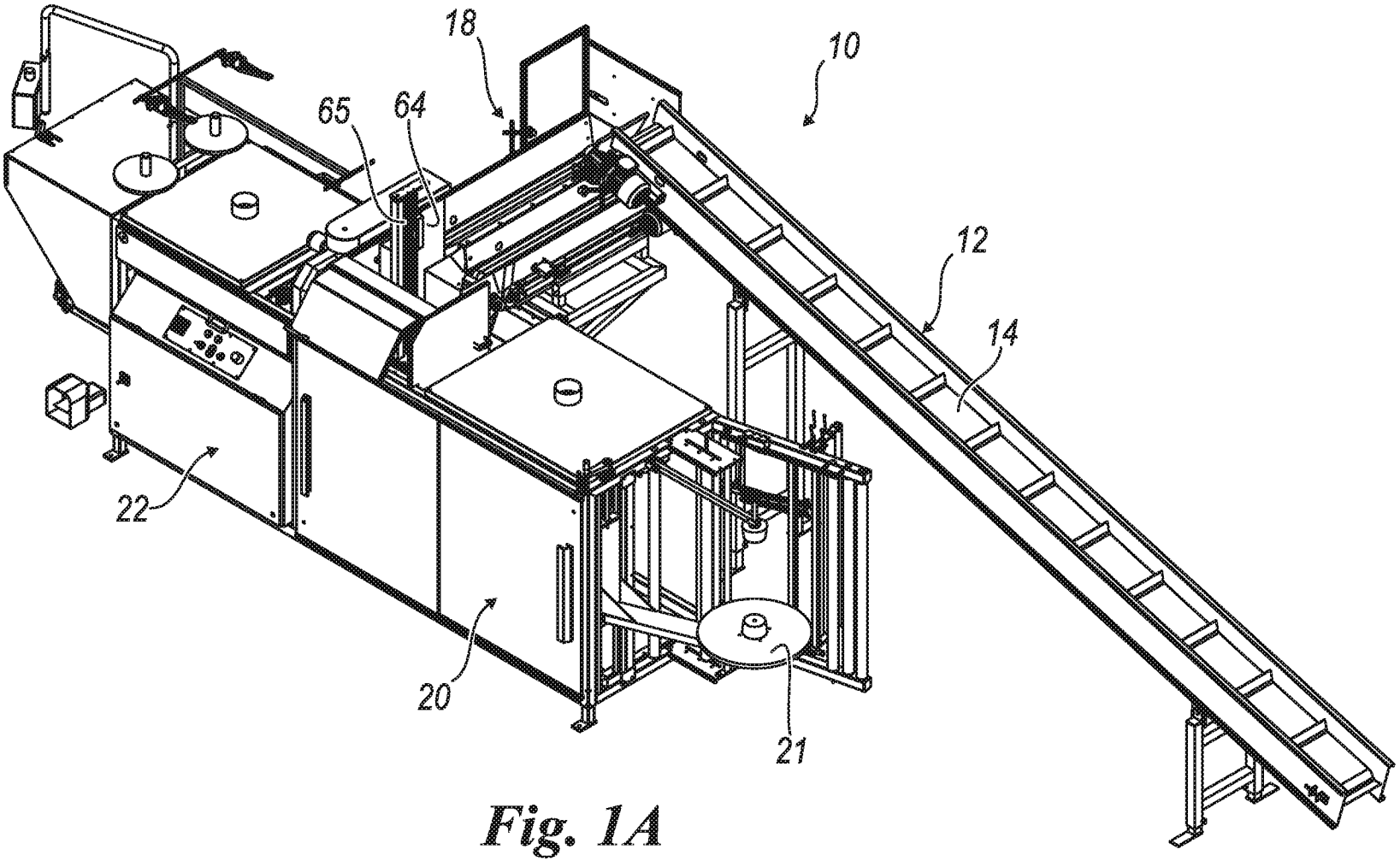
Figure 2:
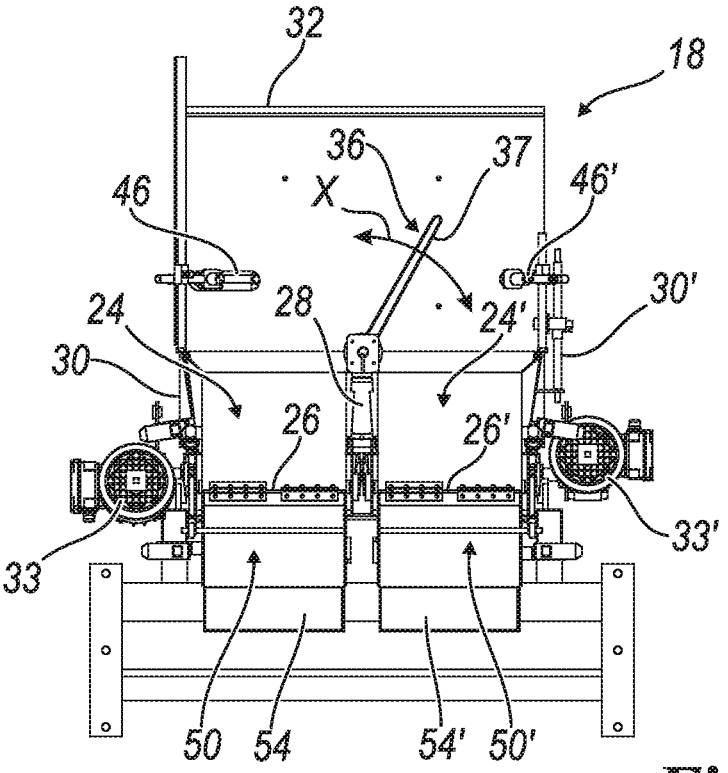
Figure 3:
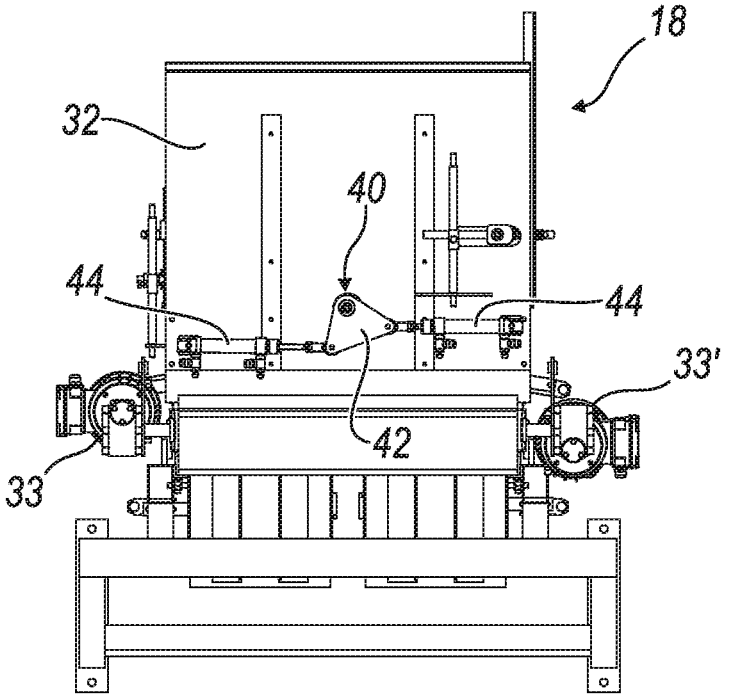
Figure 4:
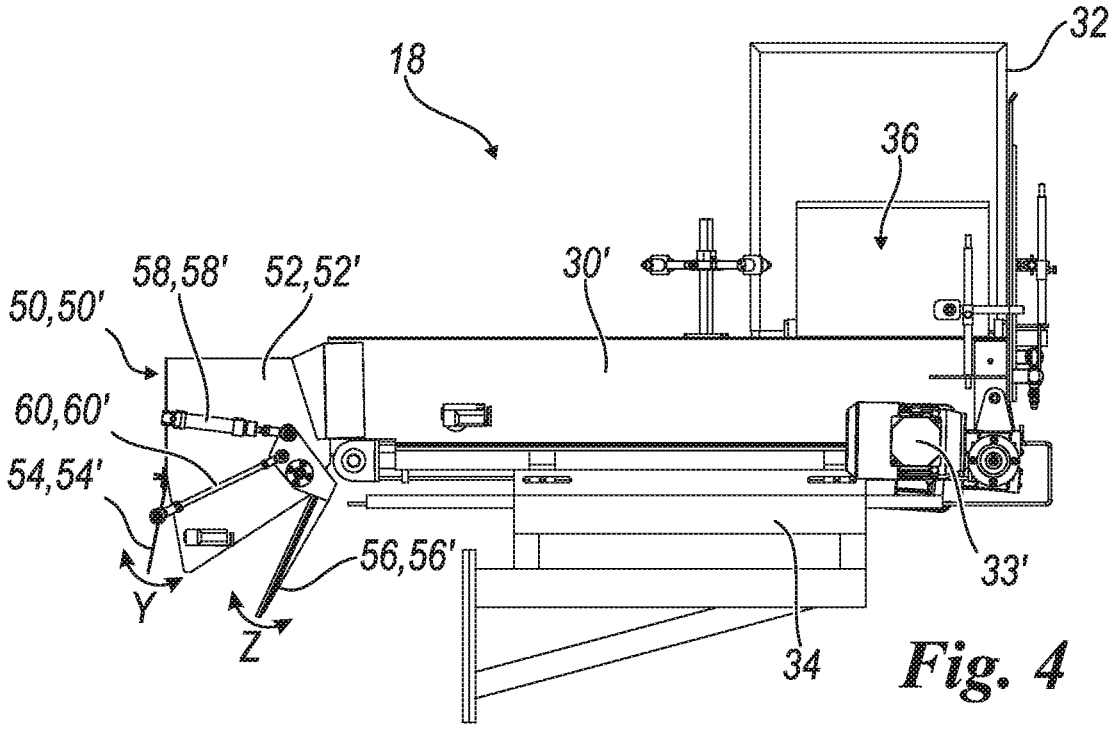
Figure 5:
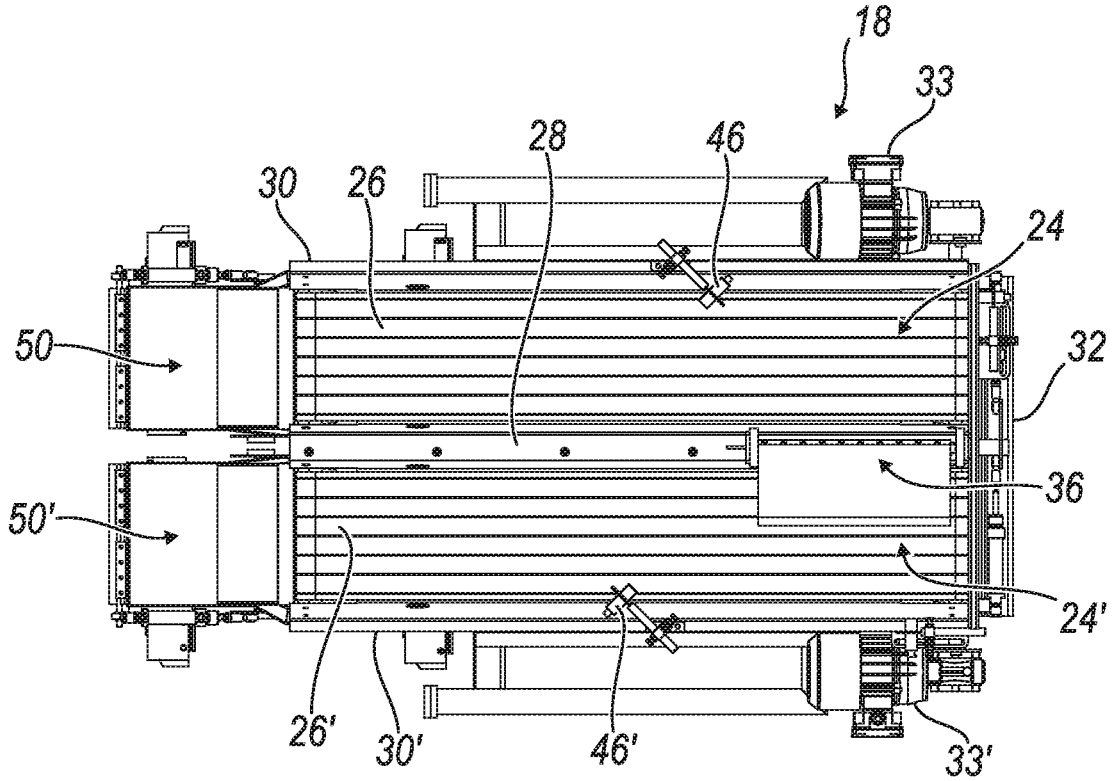

The constructional and functional characteristics of the enhanced apparatus for filling bags according to the present invention can be better understood from the following detailed description, wherein reference is made to the attached drawings which illustrate a preferred, non-limitative embodiment, and wherein:

FIG. 1 schematically shows a top view of the enhanced apparatus for filling bags according to the present invention;

FIG. 1A schematically shows an axonometric view of the apparatus for filling bags according to the invention;

FIG. 2 schematically shows a front view of a workstation or module of the apparatus according to FIG. 1;

FIG. 3 schematically shows a rear view of said workstation or module according to FIG. 2;

FIG. 4 schematically shows a side view of the same workstation or module;

FIG. 5 schematically shows a top view of the workstation or module according to FIG. 2.

DETAILED DESCRIPTION OF THE INVENTION

With reference to the mentioned figures, the enhanced apparatus for filling bags according to the present invention, identified by the reference numeral 10 as a whole in FIG. 1, comprises a feeding station 12 consisting of a conveyor belt 14, the function of which is to feed first bags filled with products, for instance fruit and vegetable products/food, to a filling station 18 described in details here below, a meshed material feeding station 20 used to form second bags suitable for accommodating the first bags 16 according to what described below, said station being equipped with a support 21 for a meshed material coil for second bags (not shown in the figures), such second bags being closed and separated from each other by way of a cut in a closing and cutting station 22.

With a specific reference to the apparatus according to the preferred embodiment illustrated in FIG. 1, the feeding station 12 used to feed the first bags 16 and the meshed material feeding station 20 for the second bags are arranged upstream of the filling station 18, whereas the second bag closing and cutting station 22 is arranged downstream of said filling station 18.

In addition, the meshed material feeding station 20 for second bags and the second bag closing and cutting station 22, being already known, will not be the objects of a further detailed description with reference to the constructional and functional components of said workstations.

However, it is understood that the meshed material feeding station 20 for second bags and the closing and cutting station 22 co-operate in forming said second bags suitable for accommodating the first bags 16 coming from the filling station 18, as described in details below. In particular, the second bags are formed starting from a meshed material (or another type of material suitable for the purpose) coming from the coil 21 in the station 20 and comprising two facing layers coupled with each other along a continuous horizontal line (in correspondence with the lower portion of said second bags) and according to vertical lines which delimit each individual second bag laterally, whereas the upper portion of said second bags is open to make it possible to insert the first bags 16 thereinto.

According to the known art, the second bags thus formed move forward discretely and by way of a known conveyor belt and stop below the filling station 18 for the insertion of the individual first bags 16 and, subsequently, said second bags filled with the first bags move forward in the forming and closing station 22, where they are sewn or welded in correspondence with the open upper portion and are separated from each other by way of a cut made in correspondence with two lateral pre-weldings of two adjacent bags.

The filling station 18, which is shown in more details in FIGS. 2 thru 5, comprises a pair of parallel and side-by-side transportation lines 24 and 24', each comprising a conveyor belt, identified by the reference numerals 26 and 26' respectively, separated from each other by way of a diaphragm 28 and laterally delimited by opposed lateral walls 30 and 30' and, on the rear side, by a rear wall 32 arranged at the opposite side as referred to the above described stations 20 and 22; the conveyor belts 26 and 26' are movable independently of each other owing to the presence of gear motors 33 and 33' secured to a support frame 34 in said filling station 18, in correspondence with the facing lateral walls 30 and 30'.

The conveyor belts 26 and 26' are preferably of a "wave" profile type for an optimal arrangement of the handled product.

With reference to FIG. 1, it schematically shows that one end or output from the feeding station 12 is located in correspondence with and above the diaphragm 28.

At an upper end of the diaphragm 28, at the opposite side with respect to the conveyor belts 26 and 26', there is hinged a selector device 36 which is movable alternately by way of actuation means according to a direction indicated with the letter "X" in FIG. 2. As better detailed below, said selector device comprises a case 37 movable between a first position wherein it closes the transportation line 24 while leaving the transportation line 24' open and a second position wherein said selector device opens the transportation line 24 and closes the transportation line 24'; in this way, the feeding station distributes the first bags 16 into the transportation line 24 and into the transportation line 24' in an alternating and selective manner.

The operation of said case 37 of the selector device 36 according to an alternating movement is implemented via actuator means 40 which comprise a rocker 42 hinged to the case 37 in correspondence with the rear wall 32 at the opposite side with respect to said case and driven into rotation about its own fulcrum point by way of one or two actuators 44, typically pneumatic actuators, secured to said rear wall 32; in the preferred embodiment illustrated in the figures, two actuators 44, opposed to each other, are shown. The movement of the case 37 of the selector device 36 is controlled by photoelectric cells 46 and 46' or by another type of presence/position sensor, preferably secured to the opposed lateral walls 30 and 30'.

As a matter of fact, said photoelectric cells make it possible to activate the movement of the case 37 as a function of the passage of the first bags 16 in the transportation lines 24 and 24'; in particular, whenever a first bag 16, after being moved by the conveyor belt 14 in the feeding station 12 to the filling station 18, falls onto the conveyor belt 26 in the transportation line 24, for instance, it is detected by the photoelectric cell 46 which sends a signal to a control unit of the apparatus, which controls the activation of the actuation means 40 which make the case 37 move from a first position, wherein it closes the input to the transportation line 24', to a second position, wherein said case 37 closes the transportation line 24, thus enabling the input to the transportation line 24', which can receive another first bag 16.

Likewise, said other first bag 16, upon falling onto the conveyor belt 26', will activate the photoelectric cell 46', and consequently the movement of the case 37 will be activate again.

Further photoelectric cells or equivalently known presence/position sensors (not shown in the figures) are located in the transportation lines 24 and 24' and are suitable for detecting the passage of said first bags 16 moved by the conveyor belts 26 and 26'.

Each transportation line 24 and 24', on an opposite side with respect to the selector device 36, comprises a collection/accumulation device 50 and 50' respectively, suitable for receiving the first bags 16 for the function described below.

The collection/accumulation device 50 comprises a funnel-shaped container element 52 (and 52') which is open above and closed below (on the side facing the direction of a second bag loading station 19) by way of a pair of opposed flaps, mainly a first flap 54 (and 54') and a second flap 56 (and 56') respectively, hinged to said funnel-shaped container element 52 (and 52') and operated in a synchronous and simultaneous movement by way of an actuator 58 (and 58') connected to the funnel-shaped container element and to the second flap 56 (and 56') and of a lever 60 (and 60') which, being arranged in such a way as to connect the second flap 56 (and 56') to the first flap 54 (and 54'), allows to transmit motion to said first flap 54 (and 54') too; in this way, the two flaps open/close synchronously and simultaneously according to the directions indicated by the arrows Y and Z respectively in FIG. 4 (i.e. said flaps move away from each other when opening), i.e. they reciprocally move away so as to obtain an immediate opening of the funnel-shaped container (and 52') which makes the first bag 16 fall by gravity into the second bag underneath.

The second bags, open above and coming from the station 20, move below each individual collection/accumulation device 50 and 50', said bags being intended for accommodating the first bags 16 according to what described below; also, both collection/accumulation devices 50 and 50' are arranged in correspondence with one and the same second bag, but in different positions.

In correspondence with the filling station 18, the apparatus according to the invention comprises a separator 64 aligned with the diaphragm 28 in the filling station and vertically movable along a guide 65, said separator 64 being inserted into the second open bag below the collection/accumulation devices 50 and 50', while said bag is still moving to correctly position below said collection/accumulation devices so as to enable the individual first bags 16 to easily fall by gravity into said second bag upon opening of the flaps in the collection/accumulation devices.

The second bag is held open by way of guide means in said and the same second bag.

As described above, the separator 64 is aligned with the diaphragm 28 and is positioned between the collection/accumulation devices 50 and 50'; therefore, it is to be understood that said separator is confined within the dimension of longitudinal development of the filling station 18, in order to make it possible for the second bag to position directly below the collection/accumulation devices. Following the progressive fall of the first bags 16 coming from the collection/accumulation device 50 and from the collection/accumulation device 50', the mentioned separator 64 vertically and progressively moves along the guide to make it easier a correct lateral contact between two first bags 16 aligned with each other up to a complete filling of a second bag with said orderly arranged first bags.

Said separator 64 is fully extracted from the second bag before inserting the last first bags 16 into said second bag, this in order to allow for a quick movement of said second bag filled with the first bags 16 in the direction of the workstations arranged downstream of the filling station 18 and, in particular, in the direction of the forming and closing station 22, in which said second bag is closed above. The apparatus according to the invention is also provided with a control panel which makes up an operator interface to interface to a control unit and enables the operator to display and set the production steps, to monitor the working cycle, and to modify the working parameters.

Furthermore, the apparatus according to the invention comprises product presence sensors, meters, and the like suitable for acquiring the data of the production cycle and sending it to the control unit to enable the operator to adjust and modify the production cycle.

The operation of the enhanced apparatus for filling bags according to the present invention, as described in details above with reference to its own structural components, is described below.

A second bag formed in the meshed material feeding station for second bags is moved to the filling station 18 and below the collection/accumulation devices 50 and 50' where the separator 64 is lowered into the second bag keeping it open and where the guide means for said second bag keep it well open in order to receive the first bags 16 coming from the collection/accumulation devices.

Specifically, the first bags 16 are fed to the filling station 18 by way of the conveyor belt 14 in the feeding station 12 and the selector device 36 sorts the first bags in the first transportation line 24 and in the second transportation line 24' alternately, said first bags 16 being moved to the collection/accumulation devices 50 and 50' by way of the conveyor belts 26 and 26'.

The sensor which said collection/accumulation devices are equipped with detects the presence of the second bags and sends this information to the unit that controls the simultaneous opening of the flaps 54 and 56 (54' and 56') of each individual collection/accumulation device thus making it possible for the first bag to fall by gravity into the second bag.

In particular, whenever the first bag is located in the funnel-shaped container 52 (or 52'), the conveyor belt 26 (or 26') in the transportation line 24 (or 24') is stopped and when the flaps that keep said funnel-shaped container closed open to make the first bag fall down, a signal is sent to the control unit which controls and drives the movement of the conveyor belt.

In this way, the first bags fall down into the second bag immediately and orderly, the separator 64 progressively moving according to a vertical direction as the second bag gets filled.

It is worth nothing that in the filling station 18 a counting is also made of the first bags 16 that move along the first transportation line 24 and the second transportation line 24' in order to prevent that the number of first bags coming, for instance, from the first transportation line 24 and inserted into the second bag be different from that of the first bags that come from the second transportation line. In particular, if such a situation occurs, the control unit disables the opening of the flaps in the collection/accumulation device above that portion of the second bag which contains a greater number of first bags, temporarily stops the conveyor belt in the corresponding transportation line and only enables the movement of a transportation line and of the collection/accumulation device above that portion of the second bag which contains a lower number of first bags.

Once a second bag is filled with first bags 16, it is moved in the direction of the forming and closing station 22, where the second bag, now filled, is closed above and subsequently vertically cut along a separation portion from the adjacent bag.

At the same time, another second bag, empty, is moved in correspondence with the filling station and below the collection/accumulation devices in said filling station.

In this transient operating step, the flaps in the collection/accumulation devices remain closed thus preventing an accidental fall of first bags and they are only activated when the control unit receives a signal indicating the correct positioning of the second bag to be filled.

The advantages achieved by using the apparatus according to the invention are apparent from the foregoing.

The enhanced apparatus for filling bags according to the present invention advantageously makes it possible to optimize the process whereby second bags (or bigger bags) are packaged with first bags (or smaller bags), thus allowing a fast and correct filling of said second bags.

A further advantage of the apparatus according to the invention consists in that it allows to accurately monitor and count the first bags that are inserted into the second bags and to adjust the feeding of said first bags into the second bags (by way of signals provided by sensors and sent to the control unit) to guarantee a filling of second bags featuring high repeatability, i.e. a filling wherein second bags are filled with the same number of first bags, and consequently uniform between each other.

Further advantageous is the fact that the filling station comprises collection/accumulation devices equipped with opposed flaps which allow a centered and accurate fall by gravity of the first bags down into the second bag and which, being shaped as described above, also prevent the first bags from accidentally falling outside the second bag, account being also taken of the fact that the arrangement of the collection/accumulation devices makes it possible to place the second bag exactly below said flaps.

A further advantage consists in that the mentioned flaps used to close the funnel-shaped container in the collection/accumulation device, being shaped and arranged as described above and being driven synchronously and simultaneously when opening, make it possible an immediate fall by gravity of the first bag down into the second bag, thus preventing the first bag from sliding along the opening devices; as a matter of fact, in a sliding movement the first bag (meshed bag containing fruit and vegetable products) undergoes a slowing down in its fall into the second bag, because of the friction resulting from the contact of the first bag, which cause an unavoidable extension of the process times and of the consequent and associated costs.

A further advantage consists in that the apparatus according to the invention, which allows a correct, quick, and immediate as well as centered fall of the first bags down into the second bags and the filling of said second bags with a constant number of first bags, reduces the percentage of rejections due to non-conformity to the production requirements and, consequently, makes it possible to increase the yield of the production cycle by at least 20%.

Whereas the invention has been described here above with a particular reference to one embodiment, which has been described for explanatory, non-limitative purposes only, numerous modifications and variants will be apparent to those skilled in the art in the light of the above description. Therefore, the present invention is to be construed to embrace any modifications and variants that fall within the scope of the following claims.

The invention claimed is:

1. An enhanced apparatus (10) for filling bags with products, arranged in first bags (16) having dimensions smaller than second bags filled with said first bags and comprising:

a feeding station (12) which feeds first bags (16) to a filling station (18) which fills second bags with the first bags (16), a meshed material feeding station (20) used to form bands of second bags, a closing and cutting station (22) which closes and cuts second bags filled with the first bags, said filling station (18) being an intermediate station between said meshed material feeding station (20) and said closing and cutting station (22), a selector device (36), integrated in the filling station (18), the selector device (36) comprising a movable case (37) for an alternating opening and closing of parallel and side-by-side transportation lines (24, 24') in the filling station, said selector device being hinged to an upper end of a diaphragm (28) separating the transportation lines (24, 24'), wherein the selector device (36) is adapted to automatically sort and select the first bags (16) fed by the feeding station (12) and to move them onto transportation lines (24, 24') suitable for transferring said first bags (16), after being sorted, towards respective collection/accumulation devices (50, 50') for unloading said first bags into second bags;

a separator means (64) placed in correspondence with the filling station (18), said separator means being vertically movable along a guide (65), wherein the guide (65) is aligned with the diaphragm (28) along a longitudinal axis of the filling station (18), wherein the separator means (64) is positioned between the collection/accumulation devices (50, 50'), wherein vertical movement of the separator means (64) intersects the longitudinal axis of the filling station, and wherein the separator means (64) is positioned between the collection/accumulation devices (50, 50') and vertical movement of the separator means (64) along the guide (65) facilitates lateral contact between two first bags (16) aligned with each other up to a complete filling of a second bag with an orderly arrangement of first bags;

wherein the respective collection/accumulation devices (50, 50') each comprise a funnel-shaped container (52, 52') open above and closed below by way of a pair of opposed flaps comprising a first flap (54, 54') and a second flap (56, 56'), respectively, hinged to said funnel-shaped container (52, 52'), an actuator (58, 58') connecting the funnel-shaped container (52, 52') to the second flap (56, 56'), and a lever (60, 60') connecting the second flap (56, 56') to the first flap (54, 54') in order to transmit motion from the second flap (56, 56') to the first flap (54, 54'), wherein the actuator and lever are adapted to synchronously and simultaneously open and close the first flap (54, 54') and the second flap (56, 56') in order to provide a centered fall by gravity of the first bags into the second bag.

2. The apparatus according to claim 1, wherein movement of the case (37) is controlled by presence/position sensors (46, 46') which detect a presence/position of the first bags (16) and is rotationally driven by way of actuation means (40).

3. The apparatus according to claim 2, characterized in that the actuation means (40) that drive the case (37) in the selector device (36) into rotation comprise a rocker (42) hinged to the case (37) and is driven into rotation about its fulcrum point by way of one or two actuators (44).

4. The apparatus according to claim 1, further comprising:

a control panel that makes-up an operator interface which includes a control unit and enables the operator to display and set production steps, to monitor a working cycle, and to modify working parameters; and product presence sensors or meters suitable for acquiring data of a production cycle and sending the data to the control unit to enable the operator to adjust and modify the production cycle.

5. The apparatus according to claim 1, wherein the funnel shaped container (50, 50') comprises a funnel shaped sidewall.

6. The apparatus according to claim 1, wherein the first flap (54, 54') and the second flap (56, 56') are different sizes from a hinge upon which a respective flap rotates to an end of the respective flap.

7. The apparatus according to claim 1, wherein the first flap (54, 54') and the second flap (56, 56') meet along a line at a bottom of the funnel shaped container (50, 50'), and wherein said line at the bottom is closer to a front of the funnel shaped container than a back of the funnel shaped container.

8. A method for filling bags comprising the following steps:

feeding first bags (16) from a feeding station (12) to a filling station (18) by way of a conveyor belt (14), wherein the filling station (18) comprises:

a selector device (36), integrated in the filling station (18), the selector device (36) comprising a movable case (37) for an alternating opening and closing of parallel and side-by-side transportation lines (24, 24'), said selector device being hinged to an upper end of a diaphragm (28) separating the transportation lines (24, 24'), wherein the selector device (36) is adapted to automatically sort and select the first bags (16) fed by the feeding station (12) and to move them onto transportation lines (24, 24') suitable for transferring said first bags (16), after being sorted, towards respective collection/accumulation devices (50, 50');

a separator means (64) which is vertically movable along a guide (65), wherein the guide (65) is aligned with the diaphragm (28) along a longitudinal axis of the filling station (18), wherein the separator means (64) is positioned between the collection/accumulation devices (50, 50'), wherein vertical movement of the separator means (64) intersects the longitudinal axis of the filling station, and wherein the separator means (64) is positioned between the collection/accumulation devices (50, 50');

wherein the respective collection/accumulation devices (50, 50') each comprise a funnel-shaped container (52, 52') open above and closed below by way of a pair of opposed flaps comprising a first flap (54, 54') and a second flap (56, 56'), respectively, hinged to said funnel-shaped container (52, 52'), an actuator (58, 58') connecting the funnel-shaped container (52, 52') to the second flap (56, 56'), and a lever (60, 60') connecting the second flap (56, 56') to the first flap (54, 54') in order to transmit motion from the second flap (56, 56') to the first flap (54, 54'), wherein the actuator and lever are adapted to synchronously and simultaneously open and close the first flap (54, 54') and the second flap (56, 56');

feeding a second bag formed in a meshed material feeding station (20) to the filling station (18) and below the collection/accumulation devices (50, 50'), moving the separator means (64) down into the second bag, which is open, in order to allow the second bag to receive the first bags (16);

operating the selector device (36) which sorts the first bags (16) coming from the feeding station (12) alternatingly into each of the transportation lines (24, 24'), said first bags (16) being moved to the collection/accumulation devices (50, 50') by way of conveyor belts (26, 26') in the respective transportation lines (24, 24');

opening the flaps (54, 56; 54', 56') in each individual collection/accumulation device (50, 50') simultaneously and synchronously to make the first bags (16) fall by gravity into the second bag;

making the separator means (64) slide along the guide (65) and progressively lift the separator means (64) upward as the second bag gets filled with the first bags (16);

moving the second bag filled with the first bags (16) in the direction of the closing and cutting station (22) where said second bag is closed above and subsequently vertically cut along a separation portion and separated from a second adjacent bag to be filled or being filled;

wherein said steps are controlled by a control unit based on signals provided by sensors.

9. The method according to claim 8, characterized in that while the first bags (16) are fed in the filling station (18) a count is made of the first bags (16) that are conveyed in the first transportation line (24) and in the second transportation line (24'), the control unit disabling the opening of the flaps (54, 54'; 56, 56') in the collection/accumulation devices (50, 50') above that portion of the second bag which comprises a greater number of first bags, whenever the difference between the number of first bags (16) inserted into the second bag and coming from the first or second transportation line (24, 24'), temporarily stops the conveyor belt (26, 26') in the corresponding transportation line (24, 24'), and only enables the moving of one transportation line and of the collection/accumulation device above that portion of the second bag which contains a lower number of first bags (16).

10. The method according to claim 8, wherein the funnel shaped container (50, 50') comprises a funnel shaped sidewall.

11. The method according to claim 8, wherein the first flap (54, 54') and the second flap (56, 56') are different sizes from a hinge upon which a respective flap rotates to an end of the respective flap.

12. The method according to claim 8, wherein the first flap (54, 54') and the second flap (56, 56') meet along a line at a bottom of the funnel shaped container (50, 50'), and wherein said line at the bottom is closer to a front of the funnel shaped container than a back of the funnel shaped container.

* * * * *